US006799520B2

(12) United States Patent
Pavlov

(10) Patent No.: US 6,799,520 B2
(45) Date of Patent: Oct. 5, 2004

(54) PANEL TRUCK FOR CHANGING A RAILWAY SECTION AND A POINT WORK

(76) Inventor: Boris Konstantinovich Pavlov, Shelepihkinskoe shosse, 11, Korp. 3, Apt. 53, Moscow 123290 (RU)

( * ) Notice: Subject to any disclaimer, the term of this patent is extended or adjusted under 35 U.S.C. 154(b) by 5 days.

(21) Appl. No.: 10/275,757

(22) PCT Filed: Mar. 6, 2001

(86) PCT No.: PCT/RU01/00098

§ 371 (c)(1),
(2), (4) Date: Nov. 7, 2002

(87) PCT Pub. No.: WO01/86069

PCT Pub. Date: Nov. 15, 2001

(65) Prior Publication Data

US 2003/0140814 A1 Jul. 31, 2003

(30) Foreign Application Priority Data

May 10, 2000 (RU) ..... 2000111227

(51) Int. Cl.[7] ..... E01B 27/17; E01B 29/04; E01B 29/06; E01B 29/16

(52) U.S. Cl. ..... 104/7.1; 104/9

(58) Field of Search ..... 37/104, 105, 106, 37/107; 171/16; 104/2, 3, 4, 5, 6, 7.1, 7.2, 7.3, 8, 9, 130.01, 307

(56) References Cited

FOREIGN PATENT DOCUMENTS

| | | |
|---|---|---|
| DE | 473 732 C | 3/1929 |
| FR | 1 002 049 A | 3/1952 |
| FR | 2 325 765 A | 4/1977 |
| FR | 2 561 275 A | 9/1985 |
| RU | 1 437 460 A | 11/1988 |

*Primary Examiner*—Christopher J. Novosad
(74) *Attorney, Agent, or Firm*—Frishauf, Holtz, Goodman & Chick, P.C.

(57) ABSTRACT

A laying machine is provided for repair and construction of railway tracks. The laying machine includes a frame, railway trucks, upper and lifting mechanisms for lifting and laying switches and railway sections, two rods connected at the lower part of the frame, and two power cylinders. The laying machine also includes a bracket-swing crane and a retractable support with a pusher, which removes the third rail from the railway section surface. The present invention allows reducing the cost of repair works.

3 Claims, 3 Drawing Sheets

PANEL TRUCK FOR CHANGING A RAILWAY SECTION AND A POINT WORK

FIELD OF THE INVENTION

The present invention relates to a machine for repair and construction of railway tracks, and in particular to machine for work in tunnels and particularly in a subway.

BACKGROUND OF THE INVENTION

Railway switches are subjected to deterioration and therefore should be replaced more often than other railway section. However, replacing work is difficult because of limited area conditions and short time conditions due to train schedules.

It is common knowledge that replacement work on railway tracks is currently executed by consecutively replacing worn elements for new ones. Performing the work by hand makes it longer and requires a great number of qualified workers. This work is more difficult when it is necessary to replace all railway sections in a subway, which includes temporary dismantling of the third rail.

One type of laying machine which is currently known is composed of a frame mounted on railway trucks situated at sides of the frame, upper and lower lifting mechanisms which are designed for lifting and laying of railway sections, two rods connected by hinges t the lower part of the frame and two power cylinders with cases connected to the central part of the frame by hinges, wherein each of the cylinder rods is connected by a hinge to another side of rods (USSR Certificate of Invention No. 1437460, E 01B 29/02, 1988).

This laying machine can not be used for replacing of railway sections and switches in subway tunnels where the third rail conductor is situated with strings, welding joints and connectors which are not in coincidence with railway joints.

When temporarily dismantling/mounting of the third rail necessary during replacement of the railway section, the labor volume increases, and in some cases the dismantling/mounting of the third rail is not possible technically.

SUMMARY OF THE INVENTION

Replacement of a railway section and a switch includes prior delivery of new railway sections and laying along railway track, temporary dismantling of the third rail, dismantling the section or switch to be replaced, mounting a new section or switch, transportation of the replaced sections to a storage are and mounting the third rail. All dismantling and mounting work is executed with an assembled railway section or switch.

It is an object of the present invention to provide a laying machine for replacing a railway section and switch which extends the functionality of the laying machine without changing its dimensions so as to enable the laying machine to be moved to a transportation position with a railway section or a switch in subway tunnels and to perform replacement work with railway sections and switches in subway tunnels, on bridges and on limited area railway tracks. It is an additional object of the present invention to speed up replacement work and reduce a number of workers by reducing hand work and labor volume during repair work.

To achieve the objects of the invention a laying machine for replacing a switch and a railway section is provided which includes a frame, railway trucks situated at sides of the frame, upper and lower lifting mechanisms which are designed for lifting and laying a railway section, at least two rods connected by hinges on a first side at the lower part of the frame, and at least two power cylinders with cases connected by hinges to the central part of the frame, wherein each of the cylinder rods is connected by a hinge to a second side of the rods. In order to remove the third rail of a railway section surface, the laying machine also includes first means situated at an upper part of the frame and second means situated at a lower part of the frame.

The frame's tails can also be mounted on wagon trucks.

The first means includes at least one bracket-swing crane for lifting the third rail, and the second means includes at least one mechanism for moving the third rail in a horizontal plane.

The mechanism for moving the third rail in the horizontal frame is a retractable support, which is mountable to the frame on a first side and on a second side is connected by a hinge to a pusher which is adapted to move the third rail.

The laying machine is equipped with back balances which are movable in a cross direction.

The laying machine may be equipped with an auxiliary lifting mechanism which is mounted under the frame on the monorail and is designed for installing or replacing switch ties.

The laying machine according to the present invention enables the replacement of the railway section or the switch in a subway tunnel in a short time and with a limited number of workers.

DETAILED DESCRIPTION

Figure 1:
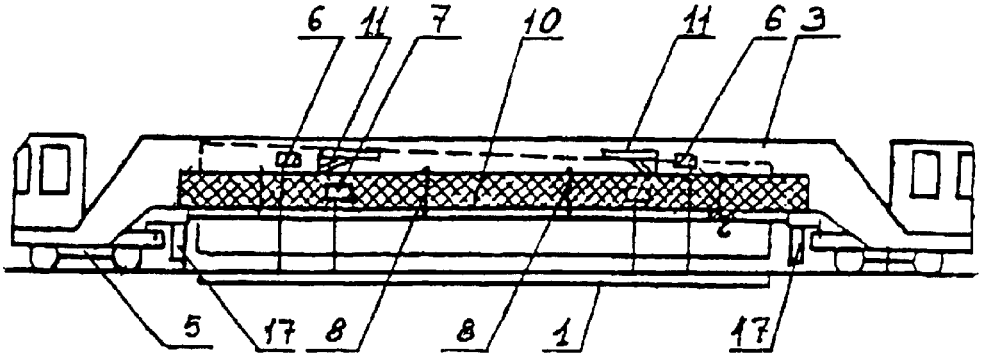
FIG. 1. is a general view of the laying machine according to the present invention with two bracket-swing cranes.
Figure 2:
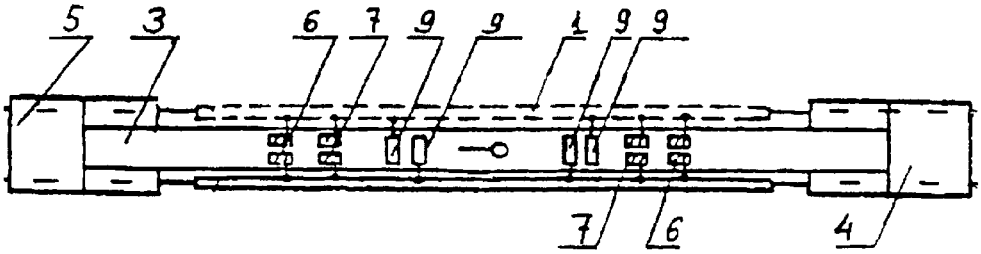
FIG. 2. is a top view of the laying machine according to the present invention with one bracket-sawing crane.
Figure 3:
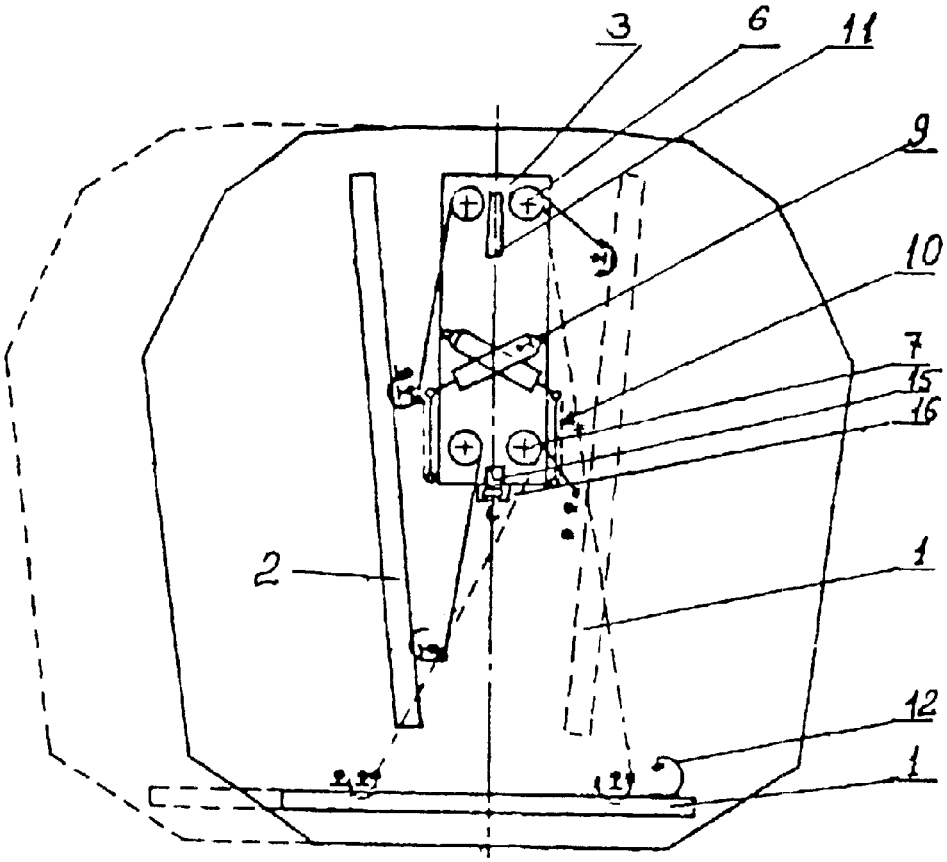
FIG. 3. is a schematic view showing loading of the old railway section.

As shown in FIGS. 1 and 2, the laying machine for replacing the old section 1 of the railway track with the new section 2 of the railway track includes a frame 3 with a rectangular cross-section, and two railway trucks 4 and 5 with control cabs situated on the sides of the frame 3. On each lateral side of the frame 3 two lifting mechanisms 6 with a rail grab are mounted on the upper part and two lifting mechanisms 7 with a rail grab are mounted on the lower part. Four rods 8 are connected by hinges on a first to the lower part of the frame 3. Four power cylinders 9 have cases that are connected by hinges to the central part of the frame 3. Each of the cylinder rods is connected by a hinge to a second side of the rods 8.

The mechanisms 6 and 7 are mounted with the possibility of turning in a plane perpendicular to a horizontal midline of the frame 3.

The case of each cylinder 9 is connected by a hinge to the frame 3 between the pairs of mechanisms 6 and 7, and the rods of the cylinders 9 are connected by hinges to rods 8. Safety grates 10 are situated between corners of the frame 3 and the rods of the cylinders 9.

Figure 4:
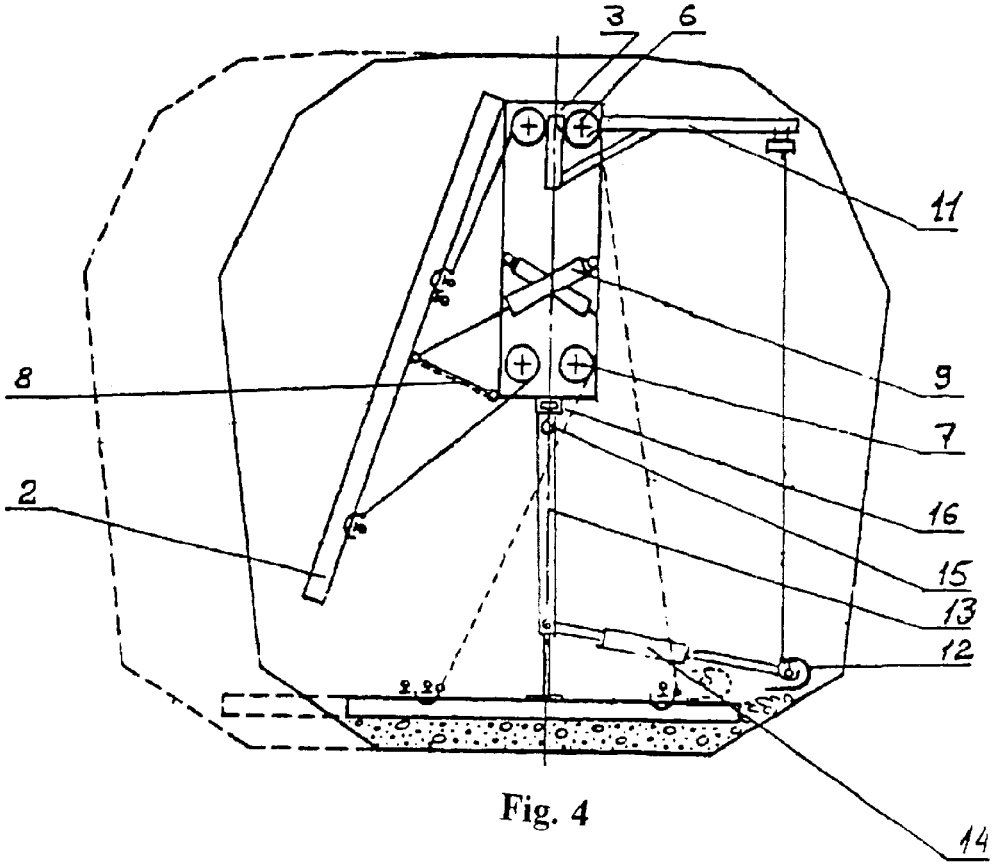
FIG. 4. is a schematic view showing the removal of the third rail.

As shown in FIGS. 1 and 4, in the upper part of the frame 3 the laying machine is equipped with bracket-swing cranes 11 for lifting the third conductor rail 12. In the lower part of the frame 3 the laying machine is equipped with retractable support 13 which is connected to the frame 3 on a first side and is connected by a hinge to the pusher 14 on a second side. The pusher 14 is designed to move the third conductor rail 12.

The laying machine is equipped with auxiliary lifting mechanism 15 which is mounted below the frame 3 on a monorail 16 and is designed to install new switch ties.

Under the ends of the frame 3 near the trucks 4 and back balances 17 are mounted movable in a direction perpendicular to a vertical midline of frame 3.

In the subway tunnel the laying machine functions as follows:

First, before the beginning of work on the lateral side of the frame 3 the new railway section 2 is located by lifting mechanisms 6 and 7 and is fixed at a vertical position for transportation, and the back balances 17 are moved in a direction of the lateral side opposite to the side on which the new section 2 of railway is loaded.

The loaded laying machine is transported to the place of work by a locomotive and the frame 3 is situated over the old section 1 which is to be replaced.

After the voltage break the third conductor rail 12 is lifted by the bracket-swing cranes 11 and is moved by the pushers 14 of the rods 13 to the nearest wall of the tunnel, thereby releasing the third conductor rail 12 from the old railway section 1. A new section 2 is moved by power cylinders 9 to the opposite wall of the tunnel and is held at an oblique position relative to the frame 3 by the rods 8.

On the free side of the frame 3 the old section 1 is lifted by pair-wise switching of the lifting mechanisms 6 and 7 by rail grabs and is installed on the frame 3 at the opposite side of the frame to the new section 2.

The old section 1 as well the new section 2 are moved from their positions under the frame 3 by power cylinders 9 to the walls of the tunnel and are held at an oblique position relative to the frame 3 by rods 8.

After lifting of the old section 1 the ballast section of the railway bed is laid out, and then new switch ties are laid by the auxiliary lifting mechanism 15.

The rods 8 are turned by power cylinders 9 such that the old section 1 and the new section 2 are moved into a vertical position.

The new section 2 is laid on the ballast section of the railway bed and the railway track is aligned.

The third conductor rail 12 is lowered by bracket-swing cranes 11 and is fixed by pushers 14 at its initial position on ends of ties of a new section 2.

The invention can be widely used during repair work in tunnels under limited time conditions without breaking train traffic, especially in a subway during the replacement of worn railway sections and/or switches.

The present invention enables prompt replacement of a worn railway section by a small number of workers, and allows replacement work during the every-day technical interval. The necessary equipment to manufacture the laying machine of the present invention is composed of elements used by the Railway Repair Service and it can be made at the broad machine plant that is, as a rule, an integral part of the Railway Service.

A specialist can understand that all mentioned means of the invention should be considered in a large technical sense with application of the notion "technical equivalents" for each of them. So, the term "frame" (3) implies the supporting girder with cross-section, which corresponds to strength/design requirements. This cross-section can be a box-shaped construction or a tube construction, for example, with an oviform cross-section. As "railway trucks" (4,5) motor open wagons can be used which are equipped with driving gear for the self-movement of the laying machine to the place of work. Workers can go to the place of work in these wagons. "Power cylinders" (9) also imply any applicable mean, for example, hydro- or pneumocylinders or the pair screw-nut with electric drive. It is not difficult for the specialist using the above mentioned principals to chose necessary means, which correspond to the requirements of the specific conditions.

What is claimed is:

1. A laying machine for replacing railway switches and railway sections comprising:

a frame, railway trucks situated at sides of the frame, upper and lower lifting mechanisms for lifting and laying the railway sections and the switches, at least two rods each having a first side which is connected by a hinge to a lower part of the frame, at least two power cylinders having (i) cases connected by hinges to a central part of the frame, and (ii) cylinder rods each connected by a hinge to a second side of the at least two rods, a first mechanism for moving a third rail situated at an upper part of the frame, and a second mechanism for moving the third rail situated at the lower part of the frame.

2. The laying machine according to claim 1, wherein the first mechanism comprises at least one bracket-swing crane for lifting the third rail, and the second mechanism moves the third rail in a horizontal plane.

3. The laying machine according to claim 2, wherein the second mechanism comprises a retractable support which is fixed to the frame on a first side and on a second side is connected by a hinge with a pusher for moving the third rail.

* * * * *